United States Patent [19]

Updike

[11] 4,094,280

[45] June 13, 1978

[54] VALVE ROTATING DEVICE

[75] Inventor: Stanley H. Updike, Painesville, Ohio

[73] Assignee: TRW Inc., Cleveland, Ohio

[21] Appl. No.: 703,071

[22] Filed: Jul. 6, 1976

[51] Int. Cl.[2] ..... F01L 1/32; F16K 29/00

[52] U.S. Cl. ..... 123/90.3; 137/331; 267/167

[58] Field of Search ..... 137/331; 123/90.28, 123/90.29, 90.3; 267/167, 33

[56] References Cited

U.S. PATENT DOCUMENTS

| | | | |
|---|---|---|---|
| 3,421,734 | 1/1969 | Updike et al. | 123/90.3 X |
| 4,011,397 | 3/1977 | Bouche | 267/167 X |

*Primary Examiner*—Martin P. Schwadron
*Assistant Examiner*—Richard Gerard

[57] ABSTRACT

An improved garter spring actuated valve rotator device wherein annular spring damping means are included internally of the coils of the garter spring.

8 Claims, 7 Drawing Figures

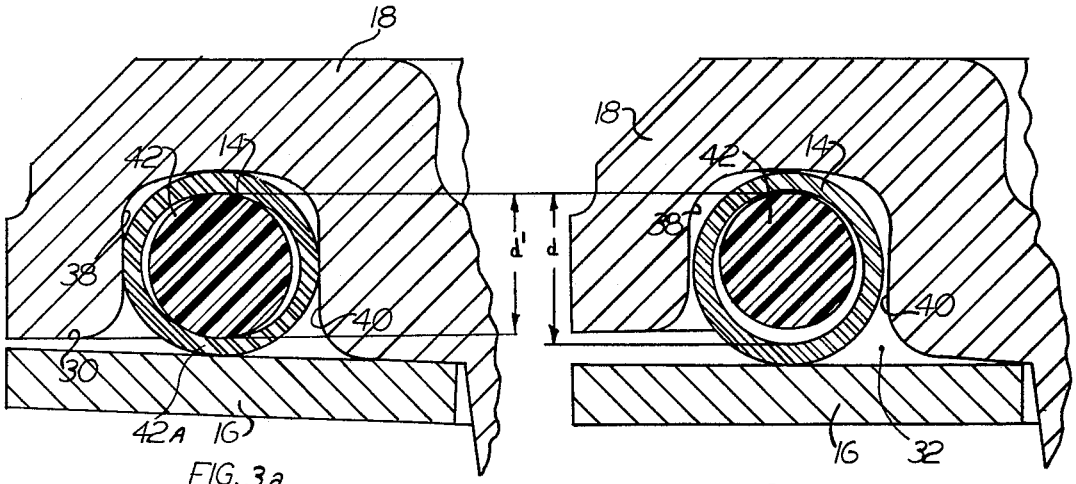
FIG. 3a
FIG. 3
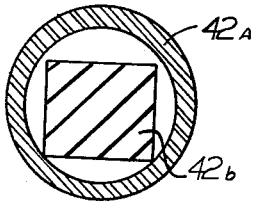
FIG. 4
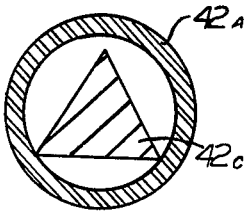
FIG. 5
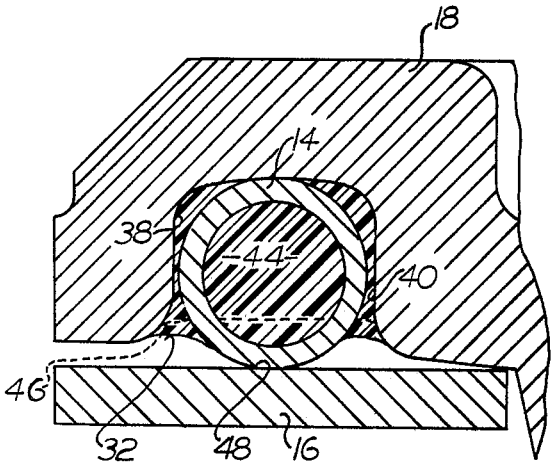
FIG. 6

VALVE ROTATING DEVICE

BACKGROUND OF THE INVENTION

The present invention relates to an improved valve rotating device of the garter spring type.

Valve rotators utilizing a garter spring for effecting valve rotation are known. Typically, a device of the general type contemplated is disclosed in U.S. Pat. No. 3,421,734 issued to Updike et al. and dated Jan. 14, 1969, the disclosure of which is incorporated herein in its entirety by reference thereto. Such rotator devices locate the garter spring between a spring washer in circular contact with the garter spring and valve spring retainer means including an annular pocket dimensioned for limited interference contact between the garter spring and the spring washer. For example, in the Updike patent, there is provided a garter spring 30, coacting between a spring washer 33 and an annular pocket 19 in the body 10. The body 10 having a taper 13 engages the valve stem 24 having a mating taper 27 to lock the body 10 to the valve stem and retain and transmit the tension of the valve spring 48 to the valve.

Other garter spring type valve rotating devices are shown in the U.S. Pat. to Orent, No. 3,537,325 dated Nov. 3, 1970 and the U.S. Pat. to Schonlau et al., No. 3,890,943 dated June 24, 1975. The structures of these devices may also be improved in accordance with the present invention.

It has been found that with the side-loaded garter spring type valve rotating devices, the springs are subject to dynamic overloading and excitation by certain resonant frequencies. They are also subjected to high tensile stresses due to the twisting of the garter spring brought about by the uneven spacing between the coils at the inner and outer pocket diameter as hereinafter more particularly explained. The inner coils being more closely spaced make contact and the outer coils remain free to move tangentially when the garter spring tilts thus creating a distortion of the coil shape as the spring collapses. These additional loads can increase garter spring stresses significantly beyond the design loads and under some operating conditions, can lead to short term fatigue failures.

For example, in the Updike patent, the garter spring while provided with a retainer 32 the purpose of which seems to be to aid maintaining the shape of the garter spring 30 during assembly, is still subject to stresses, fatigue and the like mentioned above.

Briefly stated, the present invention is in a valve rotating device having a garter-type spring coacting, during reciprocation of the valve, between a spring washer in circular contact with the garter spring and a valve spring retainer member having an annular pocket dimensioned for limited interference contact between the garter spring and the spring washer. The improvement of the present invention is in the provision of annular spring damping means coacting internally of the garter spring.

In particular embodiments of the invention, the damping means is dimensioned to exert little or no resilient compressive force on the garter spring coils in the relaxed condition, but to compressively engage the coils of the garter spring during deflection of the spring.

The damping means may have a variety of different cross-sectional configurations and further may be made of a variety of different materials. In one preferred embodiment, the damping means is made of an elastomeric material cast in place and cured.

BRIEF DESCRIPTION OF THE DRAWINGS

The present invention may be better understood by having reference to the drawings of the aforesaid Updike et al. U.S. Pat. No. 3,421,734 and the annexed drawings wherein:

FIG. 3 is a fragmentary cross-sectional view on an enlarged scale and showing the location of the garter spring in the annular pocket and in coacting relation with the circular spring washer with the damping means in place, the apparatus being in the relaxed state;

FIG. 3*a* is like FIG. 3, but shows the coils of the garter spring undergoing deflection and in contact with the spring damping means;

FIG. 4 shows another form of spring damping means having a square cross section;

FIG. 5 is a cross-sectional view showing another form of the invention wherein the spring damping means has a triangular cross section; and FIG. 6 is a cross-sectional view showing another form of the invention wherein the spring damping means is cast into the annular pocket with the garter spring in place, and cured.

DETAILED DESCRIPTION OF THE PREFERRED EMBODIMENT

Figure 1:
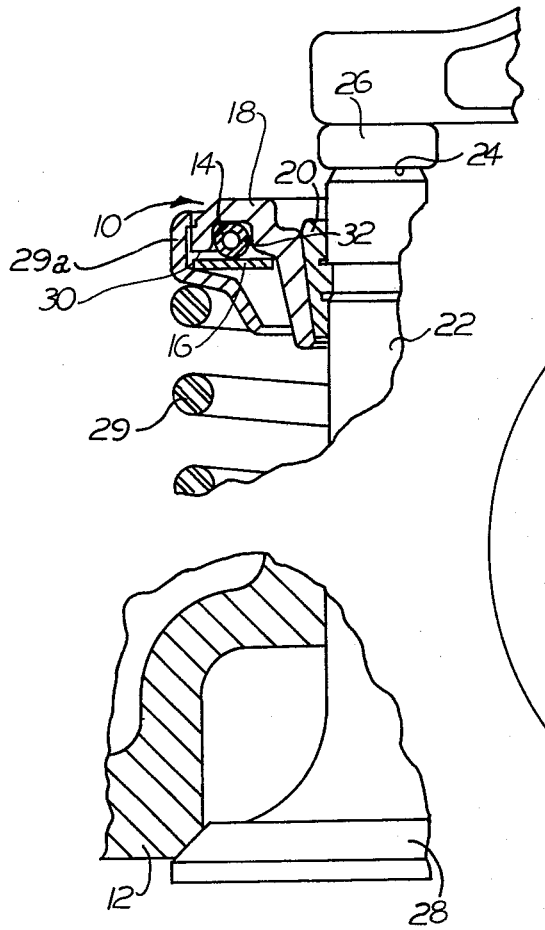
FIG. 1 is a partially cut-away, partially sectioned and partial elevational drawing showing a valve assembly of an internal combustion engine utilizing the valve rotator assembly of the present invention and showing the garter spring in the free or as-installed condition.

Referring now more particularly to FIG. 1, there is here shown a valve rotator of the garter-spring type, generally indicated at 10, for rotating a valve 28 carried on a valve stem 22. The valve 28 is associated with the cylinder head 12 of an internal combustion engine. As is known, in the garter spring type of rotator, rotation of the valve is induced by deflection of a side-load garter spring 14. The garter spring 14 coacts between a spring washer 16 and a disc or body member 18. The body member 18 is restrained or held on the valve stem 22 by a lock or keeper 20. Rotation of the body member 18 will result in rotation of the valve stem 22 and valve 28.

Loading of the valve stem end 24 through the rocker arm pad 26 causes the valve stem 22 and valve 28 to move against the bias of valve closing spring 29. The spring 29 acts between a spring retainer 29*a* and the cylinder head 12 to bias the valve 28 closed. Further, loading of the valve stem end 24 deflects the garter spring 14 which, in a known manner, transmits a rotary motion to the valve 28 relative to the cylinder head 12, until such time in the cycle when the frictional contact between the garter spring 14 and the spring washer 16 is such that a sliding action rather than a driving action takes place and the spring 14 collapses. A washer stop surface 30 limits the deflection of the spring washer 16 and prevents overstressing of the garter spring 14.

Figure 2:
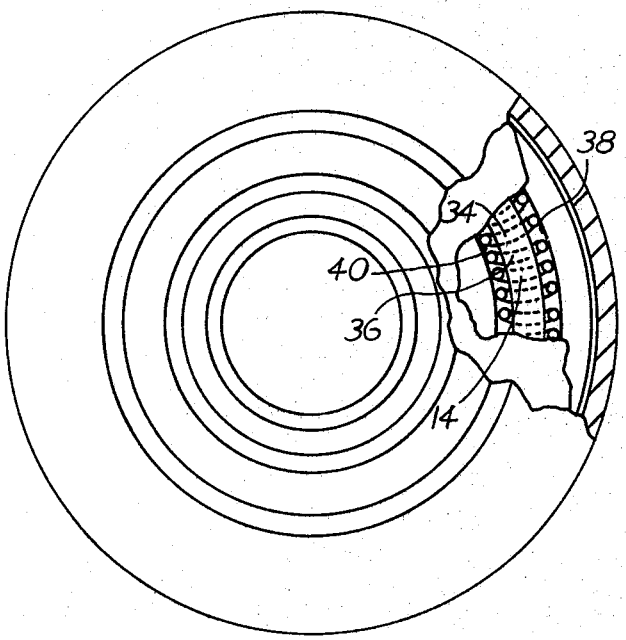
FIG. 2 is a top plan view on an enlarged scale and partially cut away showing the garter spring, the internal damping means and the annular pocket in the valve spring retainer for containing the garter spring.

However, the side-loaded garter spring 14 is still subject to dynamic overloading and excitation by certain resonant frequencies. It is also subjected to high tensile stresses due to the twisting of the garter spring 14 brought about by the uneven spacing between the coils at the inner and outer diameters of the pocket 32 in the body 18. This difference in spacing is more clearly shown in FIG. 2. It will be there noted that the spacing between the coils 34 and 36, for example, adjacent the outer pocket wall 38 is greater than the spacing between the coils 34 and 36 adjacent the inner pocket wall 40. The portions of the coils 34 and 36 being closely spaced as at the inner wall 40 make contact with each other, and the outer coil portion adjacent the outer pocket wall 38 remains free to move tangentially when the garter spring 14 tilts, thus creating a distortion of the coil shape as the spring 14 collapses. These loads can increase the stresses in the garter spring 14 significantly beyond design loads which under some operating conditions, and without the improvement of the present invention, can lead to short-term fatigue failure.

As is best shown in FIGS. 3 and 3*a*, there is provided internally of the garter spring 14 an annular spring damping device 42. In the embodiments shown in FIGS. 3 and 3*a*, the annular spring damping means is in the form of an O-ring having a circular cross section. When the garter spring 14 is in the relaxed condition as shown in FIG. 3, there is little or no force between the washer 16 and the body 18 of sufficient magnitude to deflect the garter spring 14. As shown in FIG. 3, the elastic insert 42 is of a smaller vertical dimension than the as-installed inner dimension (*d*) of the garter spring 14. This facilitates insertion of the insert 42 into the garter spring. However, during deflection of the garter spring, contact between the garter spring and insert 42 occurs. Thus, the free vertical dimension of the annular spring damping O-ring 42 is larger than the inner dimension of the garter spring *d'* under maximum deflection. The annular spring damping O-ring 42 will, however, permit normal rotation of the valve 28 (FIG. 1).

In a preferred embodiment of the invention, the engagement of the coils of the garter spring with the annular spring damping O-ring 42 takes place before the maximum designed deflection of the spring washer 16 or the mechanical washer stop 30 is reached. It should be apparent that during the deflection of the garter spring, the engagement of the coils of the garter spring with the annular spring damping means 42 occurs during a portion of the deflecting movement of the coils. This results in the coils of the garter spring compressing the elastomeric member. The annular spring damping O-ring 42 will then impart a damping action to the garter spring 14 which will minimize cyclic oscillation due to resonant frequencies, will increase the axial load-carrying capability of the garter spring 14 preventing its mechanical overload; and will clamp the garter spring 14 between the body 18 and spring washer 16, thereby minimizing the distortion of the spring coils, e.g., coil 42*a*, against the inner channel wall 40 and the outer channel wall 38.

The resilient member 42 may be used in many forms, such as shown in the cross-sections illustrated in FIGS. 3, 4, 5 and 6. Thus, for example as shown in FIG. 4, the resilient member 42*b* may have a rectangular cross-section, and as shown in FIG. 5, the annular spring damping insert 42*c* may have a triangular cross-section. In each of the cases shown in FIGS. 4 and 5, the vertical dimension of the inserts 42*b* and 42*c* is desirably (although not essentially) less than the inner installed dimension (*d*) of the garter spring as shown in FIG. 3 However, the vertical dimension of the inserts 42*b* and 42*c* is sufficient for damping engagement with the coil, e.g., the coil 42*a* of the garter spring 14, by being larger than the inner diameter of the garter spring under desired maximum deflection *d'*, as shown in FIG. 3*a*.

FIG. 6 shows still another embodiment which overcomes the difficulty of introducing a resilient member into a garter spring. In this embodiment, a curable, elastomeric material is cast or poured into the annular pocket 32 with the garter spring 14 in place in the relaxed condition, and the elastomer cured. A partial fill of elastomer is indicated by the dotted line 46. An amount of elastomer sufficient to fill the pocket 32 and the inside of the garter spring 14 while leaving the OD 48 of the spring exposed where it engages the washer 16, as shown in FIG. 6, is preferred.

Although in the foregoing description, the preferred annular damping insert 42 has been described as a rubber O-ring, the insert 42 may be made of many different materials which are heat resistant and oil resistant. Organic elastomers should have a minimum durometer, Shore A hardness of about 20 as determined by ASTM Procedure D-676-59T. A convenient Shore A hardness range is from about 20 to about 90. Exemplary materials include elastomeric plastic materials, with or without fillers and/or extenders, antioxidants, etc. in well known formulations, e.g., neoprene, polyvinylchloride, polyurethane, poly (dimethyl siloxane) rubber (see U.S. Pat. Nos. 2,890,188, 3,015,645, 2,541,137, 2,863,846), e.g., a commercially available self-curing bathtub caulking material, poly(butadiene-acrylonitrile) rubber (Buna-N), and even a metal, such as a steel coil. Any material which can be formed and inserted, or cast from a liquid or semi-liquid form into the garter spring and will permit the necessary deflection of the spring, but will interfere with deleterious oscillations (i.e., damping effect) may be used herein. Any suitable geometric cross-sectional configuration may be employed. The material of which the damping element is formed should, of course, be heat resistant and hydrocarbon resistant and maintain its resiliency under the particular environmental conditions of use; for example, under a valve cover in a conventional internal combustion engine. In a typical automotive engine environment, where the improved valve rotators hereof are used, the temperature range is from about 250° to about 300° F., and the parts are continually bathed in hot engine oil. Buna-N rubber having a durometer, Shore A hardness of 40 to 60 is particularly satisfactory for the pre-formed insert type of damping device, as shown in FIGS. 1–5. The room temperature self-curing poly(dimenthyl siloxane) rubbers are particularly suitable for the cast-in-place elastomers such as shown in FIG. 6.

With the conditions under which the damping devices hereof are used being known, one skilled in the art of elastomer formulation can readily provide suitable resilient, heat and oil resistant materials for either the insert or the cast forms of the invention. The design dimensions shown in FIGS. 3–5 for the insert type are preferred. It will be understood, however, that damping elements 42 can be fit into the garter spring 14 with an interference fit, a tight fit, or the loose fit which is within the dimensional limitations illustrated in the drawings. The inserts may also be cast and cured in place, either completely filling the ID of the spring or only partially filling it as shown in FIG. 6.

The insert may also be formed by injecting a liquid or semi-liquid elastomer into the garter spring and curing it in place.

What is claimed is:

1. In a valve rotating device having a garter spring for effecting valve rotation during reciprocation of the valve and which coacts between a spring washer in circular contact with said garter spring and a body member having an annular pocket for receiving the garter spring, the improvement which comprises an elastomer cast and cured in place in said annular pocket and internally of said garter spring and acting to dampen movement of the spring coils of the garter spring.

2. In a valve rotating device as defined in claim 1 wherein the elastomer partially fills said annular pocket.

3. In a valve rotating device as defined in claim 1 wherein the elastomer fills said annular pocket and the inside of said garter spring and at least partially envelopes said garter spring but allows direct contact of the outside of the garter spring with said spring washer.

4. In a valve rotating device in accordance with claim 1 wherein the elastomer is a room temperature vulcanizing poly (dimethyl siloxane) rubber.

5. A valve rotator for rotating a spring biased valve about the axis of the stem of the valve in an internal combustion engine, said valve rotator comprising:

(a) a body to be located coaxial with the valve stem, attached to and rotatable with the valve stem, said body having an annular groove therein;

(b) a valve spring retainer coaxial with and adjacent said body and adapted for contact with the valve biasing spring;

(c) a garter spring disposed in said annular groove, said garter spring comprising a series of coils;

(d) a Belleville washer located between said garter spring and said valve spring retainer and which applies a force on the coils tending to tilt the coils when said body and said valve spring retainer move axially toward each other;

(e) means located internally of the coils of said garter spring and extending coextensively therewith, said means engaging said coils and increasing the axial load capacity of said garter spring and clamping the coils of the garter spring between said Belleville washer and said body to minimize distortion of said coils as well as to minimize oscillation of the garter spring coils upon axial loading of the garter spring due to said body and said valve spring retainer moving axially toward each other.

6. A valve rotating device as defined in claim 5 wherein said means is an elastomer cast in place and cured in said annular groove.

7. A valve rotating device as defined in claim 6 wherein said elastomer partially fills said annular groove.

8. In a valve rotating device as defined in claim 5 wherein said means exerts substantially no resilient compressive force on the garter spring in the relaxed condition of the garter spring, and compressively engages the coils of the garter spring during damping action, said means having a cross-section dimensioned smaller than the free inner diameter of the garter spring and greater than the inner diameter of the garter spring during maximum deflection of the coils of the garter spring.

* * * * *